US007290595B2

(12) United States Patent
Morishita et al.

(10) Patent No.: US 7,290,595 B2
(45) Date of Patent: Nov. 6, 2007

(54) INNER FIN WITH CUTOUT WINDOW FOR HEAT EXCHANGER

(75) Inventors: Masashi Morishita, Tokyo (JP); Hisashi Onuki, Tokyo (JP); Yoshihiro Kawai, Tokyo (JP)

(73) Assignee: Calsonic Kansei Corporation, Tokyo (JP )

( * ) Notice: Subject to any disclaimer, the term of this patent is extended or adjusted under 35 U.S.C. 154(b) by 60 days.

(21) Appl. No.: 10/550,733

(22) PCT Filed: Mar. 19, 2004

(86) PCT No.: PCT/JP2004/003804

§ 371 (c)(1),
(2), (4) Date: Sep. 26, 2005

(87) PCT Pub. No.: WO2004/085948

PCT Pub. Date: Oct. 7, 2004

(65) Prior Publication Data

US 2007/0095515 A1 May 3, 2007

(30) Foreign Application Priority Data

Mar. 26, 2003 (JP) ..... 2003-086282

(51) Int. Cl.
*F28F 13/12* (2006.01)

(52) U.S. Cl. ..... 165/109.1; 165/183; 29/890.049; 72/379.2

(58) Field of Classification Search ..... 165/109.1, 165/183; 29/890.049; 72/379.2
See application file for complete search history.

(56) References Cited

U.S. PATENT DOCUMENTS

| | | | | |
|---|---|---|---|---|
| 2,488,615 | A * | 11/1949 | Arnold | 138/38 |
| 3,783,938 | A * | 1/1974 | Chartet | 165/166 |
| 5,078,207 | A | 1/1992 | Asano et al. | |
| 5,184,672 | A * | 2/1993 | Aoki | 165/109.1 |

(Continued)

FOREIGN PATENT DOCUMENTS

| | | | |
|---|---|---|---|
| DE | 32 27 146 | A1 | 1/1984 |
| EP | 1 123 763 | A3 | 9/2002 |
| GB | 2 197 450 | A | 5/1988 |
| JP | 1-98896 | A | 4/1989 |
| JP | 6-129734 | A | 5/1994 |
| JP | 2555449 | B2 | 9/1996 |
| JP | 8-313183 | A | 11/1996 |

*Primary Examiner*—Allen J. Flanigan
(74) *Attorney, Agent, or Firm*—Foley & Lardner LLP

(57) ABSTRACT

An inner fin (1) of a heat exchanger has, on front and rear faces thereof, protruding ridges (2, 3) protruding in opposite directions to each other. Grooves (4, 5) to serve as passages of a heat exchange medium are formed between the adjacent protruding ridges (2, 3). In wall portions (6) forming these protruding ridges (2, 3), cutout windows (10, 11) are formed to allow the adjacent passages to communicate with each other. Further, protruding weir portions (12, 13) are provided at bottoms of entrances of the cutout windows (10 and 11), so that the heat exchange medium hits against the weir portions to promote diffluence and stirring of the heat exchange medium, thereby enhancing heat exchange efficiency.

4 Claims, 4 Drawing Sheets

U.S. PATENT DOCUMENTS 5,560,424 A * 10/1996 Ogawa ..... 165/183
6,189,607 B1 * 2/2001 Hosoya et al. ..... 165/174
6,622,785 B2 * 9/2003 Haegele et al. ..... 165/177
6,948,557 B2 * 9/2005 Higashiyama et al. ... 165/109.1
2001/0027857 A1 * 10/2001 Emrich et al. ..... 165/109.1
2006/0048921 A1 * 3/2006 Usui et al. ..... 165/109.1

* cited by examiner

INNER FIN WITH CUTOUT WINDOW FOR HEAT EXCHANGER

FIELD OF THE INVENTION

The present invention relates to a technical field of an inner fin arranged in a tube, which is provided in a heat exchanger such as a condenser for motor vehicles or the like to constitute a passage of a heat exchange medium, to improve heat exchange efficiency, and particularly relates to an inner fin with cutout window for heat exchanger so that the cutout windows allow a heat exchange medium to flow from a passage to its adjacent passage, which are formed in walls of the inner fin, in order to further improve heat exchange efficiency.

BACKGROUND OF THE PRESENT INVENTION

Such a conventional inner fin with cutout window for heat exchanger is disclosed in, for example, Japanese Patent No. 2555449. In this conventional inner fin, a flat plate having a plurality of rectangular holes bored therein is folded in a rectangular corrugated shape, so that vertical walls and lateral walls are formed in a rectangular shape to extend continuously along the flow direction of a heat exchange medium, and a slit is formed to run along each of the vertical walls to part of the lateral walls on both sides of the vertical wall. The vertical walls and the lateral walls split the flow of the heat exchanging medium into their wall directions, and the slits allow theses split heat exchanging mediums to flow through the slits and partially mix up with each other, thereby generating the turbulence to inhibit the development of boundary layers on their walls.

However, the conventional inner fin described above has the following problem. The vertical walls and the lateral walls are formed in the rectangular shape folding to extend step-free along the flow direction of the heat exchange medium with the slits interposed therebetween. This structure can reduce pressure loss caused by a flow of the heat exchange medium in the conventional inner fin compared with that in an offset inner fin, while only small split flow of the heat exchange medium occurs from one passage to another through the slits. This reason comes from that the vertical walls and the lateral walls, as the whole structure, continuously extend step-free along the flow direction of the heat exchange medium, which makes the heat exchange medium to flow in parallel through front and rear side passages on both sides of the vertical walls at an equal speed. This brings only a small split flow through the slit to a passage to its adjacent passage, therefore, the effect of improving heat exchange efficiency has been still small.

Moreover, protruding ridges extend continuously in a width direction of the plate, and therefore, in order to obtain the passages of the heat exchange medium longer than one plate, a plurality of plates each having protruding ridges similarly to the above plate have to be arranged in the width direction and connected with adjoining plates to form one inner fin, which has led to increase in production cost.

The present invention was made in view of the problems stated above, and an object thereof is to provide a low cost inner fin with cutout window for heat exchanger that can reduce pressure loss of a heat exchange medium in a heat exchanger such as a condenser and achieve a high effect of improving heat exchange efficiency.

DESCRIPTION OF THE INVENTION

According to a first aspect of the present invention, an inner fin with a cutout window for heat exchanger includes a plurality of protruding ridges each formed by a wall portion having sidewalls formed with a cutout window, on front and rear sides of a plate respectively and extending along a longitudinal direction of a plate with a predetermined width, the front side adjacent protruding ridges sandwiching a front side groove and the rear side adjacent protruding ridges sandwiching a rear side groove to serve as passages of a heat exchange medium that separated from each other by the wall portion; and a weir portion provided at a bottom of an entrance for the heat exchange medium in the cutout window so as to allow the grooves adjacent to each other to communicate with each other. The weir portion is formed by moving material of a portion of at least one of the sidewalls toward the bottom to accumulate on the bottom and form the weir portion protruding from the bottom in a width direction of the plate so that said weir portion can promote diffluence and stirring of the heat exchange medium.

According to a second aspect of the present invention, a process for manufacturing a cutout window in an inner fin of a heat exchanger is applied to the inner fin which is provided with a plurality of protruding ridges each formed by a wall portion having sidewalls formed with a cutout window, on front and rear sides of a plate respectively and extending along a longitudinal direction of the plate with a predetermined width, the front side adjacent protruding ridges sandwiching a front side groove and the rear side adjacent protruding ridges sandwiching a rear side groove to serve as passages of a heat exchange medium that separated from each other by the wall portion. The process includes cutting out the sidewalls to form the cutout window, and moving material of a portion of at least one of the sidewalls toward a bottom to accumulate on the bottom and form a weir portion provided at a bottom of an entrance for the heat exchange medium in the cutout window so as to allow the grooves adjacent to each other to communicate with each other and protruding from the bottom in a width direction of the plate so that the weir portion can promote diffluence and stirring of the heat exchange medium.

In the inner fin structured above, due to the continuous formation of the protruding ridges in the longitudinal direction of the plate, the grooves to serve as the passages of the heat exchange medium are linearly formed, so that flow resistance of the heat exchange medium in the passages can be lowered and such an inner fin can be formed of one plate at low cost. Further, since the inner fin is provided with the cutout window formed in the wall portion and the weir portion formed at the bottom of the cutout window to protrude from the bottom of the groove, the heat exchange medium flowing along the bottom of the groove hits against the weir portion to be stirred, so that diffluence to/from the adjacent grooves is increased. As a result, the formation of boundary layers can be prevented, which makes it possible to improve efficiency of heat exchange of the heat exchange medium with the inner fin and a tube.

Preferably, the weir portion is formed on the bottom of each of the grooves both on the front side face and on the rear side face of the plate.

Therefore, the weir portions formed on the bottoms of the grooves both on the front side face and on the rear side face of the plate stir the heat exchange medium both from the front side and from the rear side, which accordingly enhances a function of stirring the heat exchange medium to prevent the formation of boundary layers, resulting in an enhanced effect of improving heat exchange efficiency.

DESCRIPTION OF THE PREFERRED EMBODIMENTS

First Embodiment

First, the structure of an inner fin according to a first embodiment of the present invention will be described.

Figure 1:
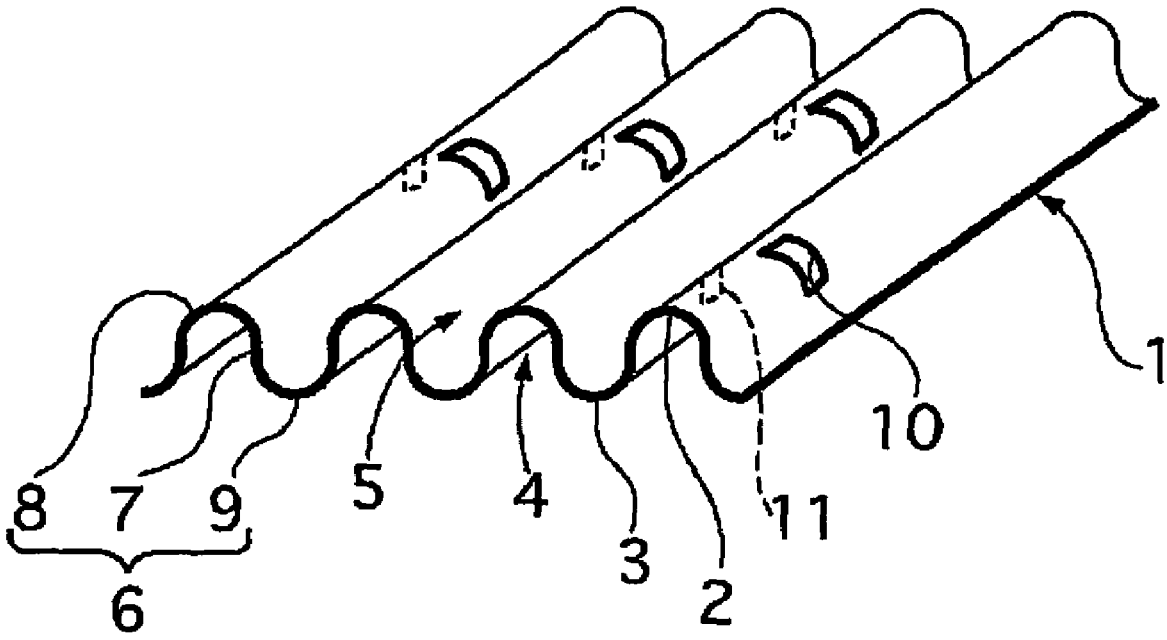
FIG. 1 is a perspective view of a plate, formed to be an inner fin, with cutout window of an embodiment according to the present invention.

In FIG. 1, a plate 1, which has a predetermined width and is formed to be an inner fin, is provided with a plurality of protruding ridges 2 and 3 alternately protruding toward the front side and the rear side, front side grooves 4 formed between the adjacent front side protruding ridges 2 and 2, and a rear side grooves 5 formed between the adjacent rear side protruding ridges 3 and 3.

The protruding ridges 2 and 3 are respectively arranged along a longitudinal direction of the plate 1 on front and rear face sides of a plate 1. Specifically, each of the front side protruding ridges 2 is formed by a wall portion 6 having adjacent sidewalls 7 and a front side bottom 8 connecting these sidewalls 7 on the front side, and each of the rear side protruding ridges 3 is formed by a wall portion 6 having adjacent walls 7 and a rear side bottom 9 connecting these walls 7 on the rear side. Therefore, the front and rear side grooves 4 and 5, each serving as passages of a heat exchange medium, are separated from each other by these wall portions 6.

The sidewalls 7 are formed step-free along the longitudinal direction of the plate 1 and has cutout windows 10 and 11 in a part thereof in the longitudinal direction. Through the cutout windows 10 and 11, the adjacent front and rear side grooves 4 and 5 communicate with each other. These cutout windows 10 and 11 are formed by cutting out one of the upper bottoms 8 and the lower bottoms 9 and moving material of portions of the sidewalls 7 toward the other one of the bottoms 9 and 8, as described in detail later.

Figure 2:
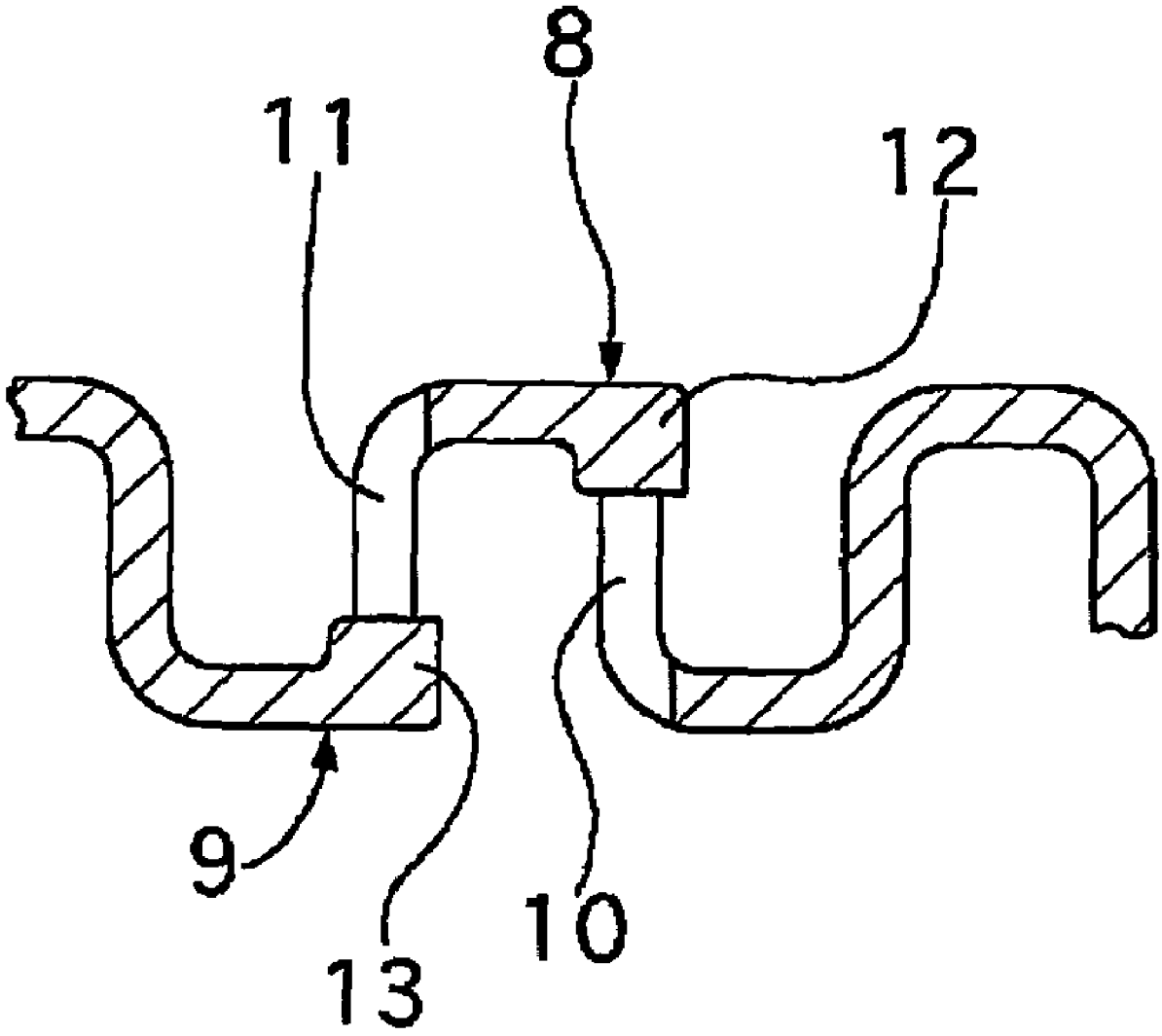
FIG. 2 is an enlarged cross-sectional view showing a part of the plate which is formed with cutout windows and weir portions of the plate shown in FIG. 1.

As a result, the material of the portions of the sidewalls 7 are moved to the other bottoms 9 and 8 and accumulate thereon respectively, so that bottoms of entrances of the cut windows 10 and 11 formed in the sidewalls 7 have weir portions 12 and 13 protruding from the bottoms 8 and 9 of the grooves 4 and 5 in a width direction of the plate 1, as shown in FIG. 2 in which a portion including the cutout windows 10 and 11 is enlarged.

Figure 3:
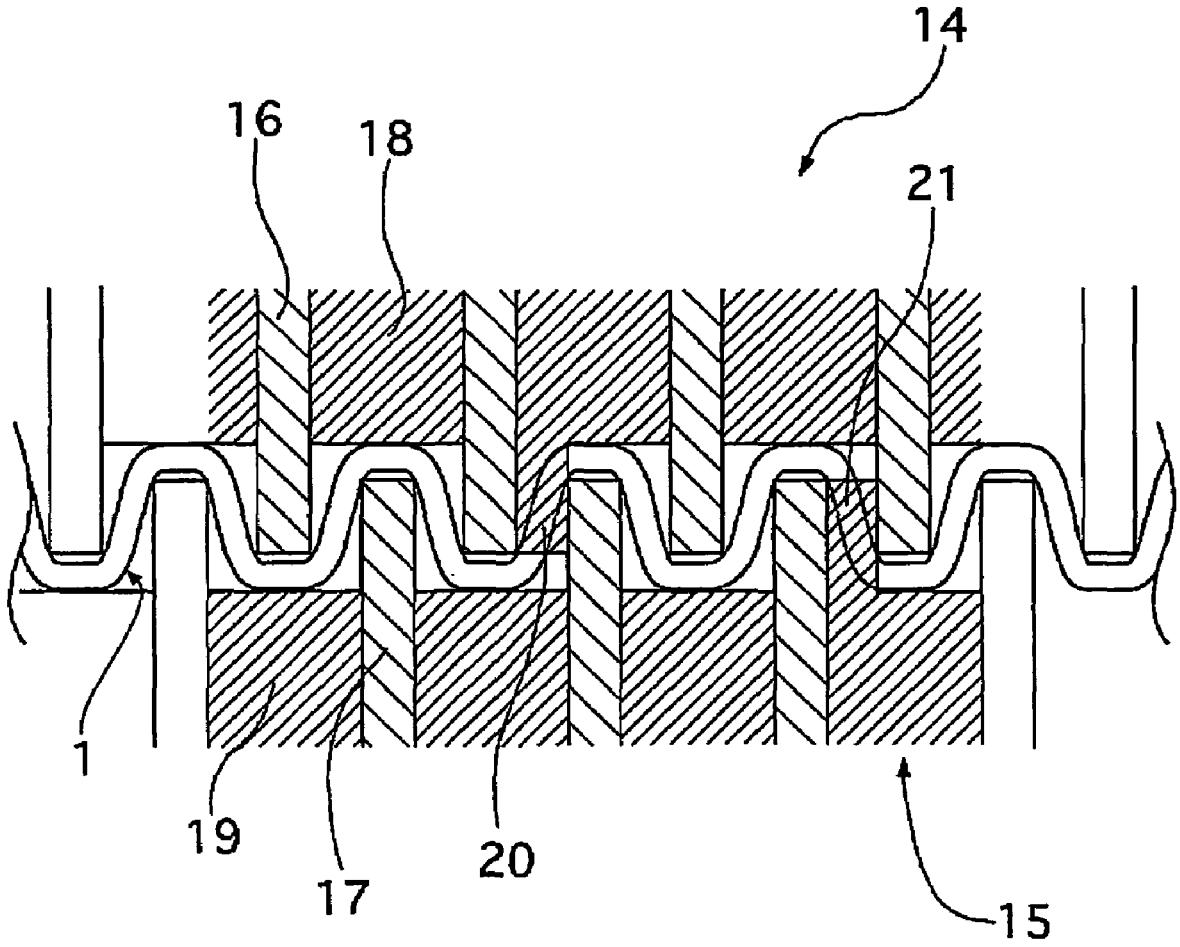
FIG. 3 is a view showing how a corrugated plate to be the inner fin shown in FIG. 1 is formed with the cutout windows and the weir portions by roll forming.

FIG. 3 shows how the cutout windows 10 and 11 shown in FIGS. 1 and 2 are formed by roll forming. The plate 1, having the protruding ridges 2 and 3 which are formed by the roll forming in a preceding step, is subsequently sent in this state to a position between an upper roll 14 and a lower roll 15 in a cutout window forming step.

The upper and lower rolls 14 and 15 are structured such that a plurality of large-diameter plates 16 and 17 and a plurality of small diameter plates 18 and 19 are alternately tiered in the width direction of the plate 1 having the protrusions 2 and 3 formed therein, and the small-diameter plates 18 and 19 have, in a part in a peripheral direction of an outer peripheral face thereof, upper and lower cutting blades 20 and 21 protruding up to the height position of the large-diameter plates 16 and 17.

In this example shown in FIG. 3, since the upper and lower cutting blades 20 and 21 are provided at the same position in the longitudinal direction of the plate 1, motive powers in a width direction for forming the cutout windows 10 and 11 from the upper side and the lower side are cancelled by each other, which enables stable roll forming.

The plate 1 in which the cutout windows 10 and 11 are formed in the above-described manner is cut to a predetermined length by a traveling cutter in a subsequent step, so that the inner fin is obtained.

Figure 4:
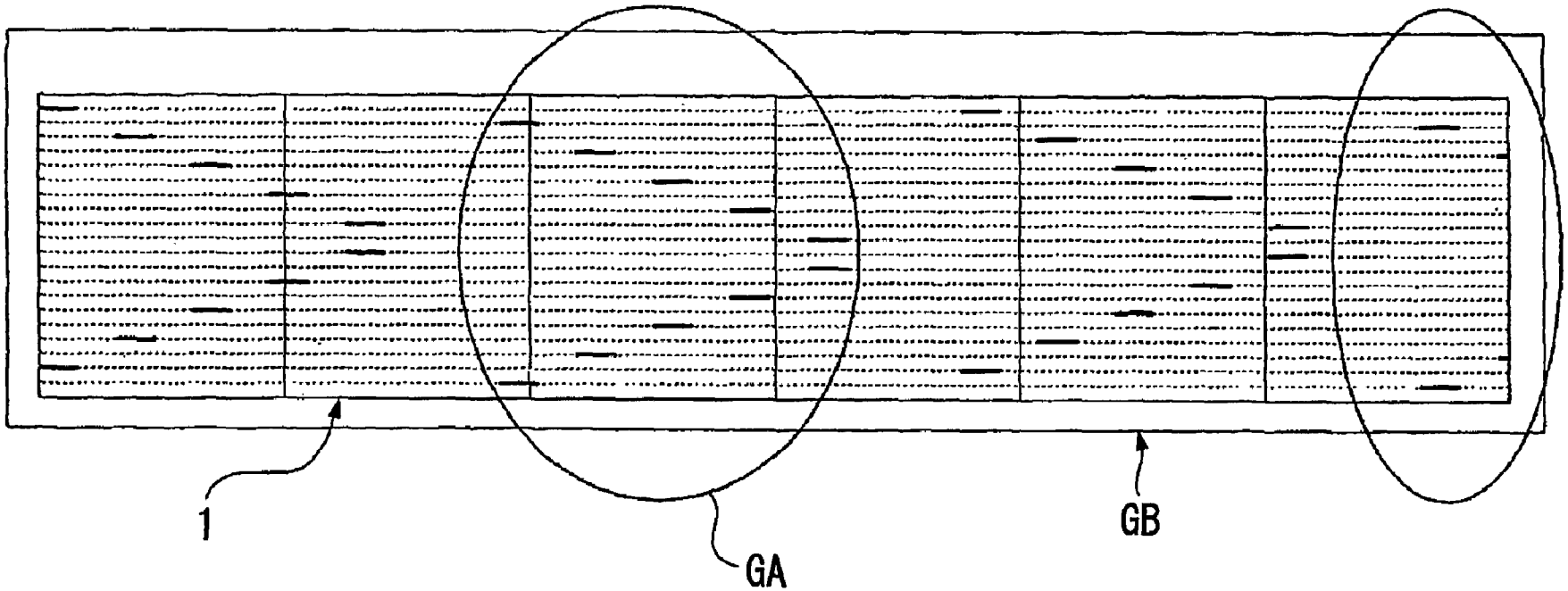
FIG. 4 is a plane view showing an example of a layout pattern of the cutout windows of the inner fin in FIG. 1.

FIG. 4 shows an example of a layout pattern of the cutout windows 10 and 11 formed by the roll forming shown in FIG. 3, a group GA indicated by a circle being cutout windows worked from the rear side and another group GB adjacent thereto being cutout windows worked from the front side.

The layout pattern and the pitch in the longitudinal direction of such cutout windows 10 and 11 can be arbitrarily set. This increases the degree of design freedom and facilitates setting of the process flow.

The inner fin formed in the above described manner is loaded in a not-shown tube, and the grooves 4 are 5 serve as passages of the heat exchange medium.

Next, the operation of the above described inner fin with cutout windows for heat exchanger and advantages thereof will be described.

The heat exchange medium flows in the groves 4 and 5 of the inner fin loaded in the tube of the heat exchanger to heat-exchange with the wall portions 6 of the inner fin. In this case, the wall portions 6 are formed step-free along the longitudinal direction, and the grooves 4 and 5 are linearly formed, this results in a low flow resistance of the heat exchange medium to reduce pressure loss caused by the flow of the heat exchange medium in the passages.

Further, the weir portions 12 and 13 are formed in the bottoms 8, 9 of the grooves 4 and 5 and they protrude in the width direction at the bottoms of the entrances of the cutout windows 10 and 11. Consequently, the heat exchange medium flowing along the bottoms 8 and 9 hits against the weir portions 12 and 13 to be swirled up by the weir portions 12 and 13, so that the split to/from the grooves 4 and 5 through the cutout windows 10 and 11 is promoted. As a result, the formation of boundary layers in the entire wall portions 6 including the bottoms 8 and 9 and the sidewalls 7 is effectively inhibited to remarkably improve heat exchange efficiency.

In the foregoing, the inner fin with cutout window for heat exchanger has been described based on the example, but the concrete structure of the present invention is not limited to this embodiment, and design change, addition, and so on may be made without departing from the spirit of the inventions according to the claim.

For example, the weir portions 12 and 13 may be formed only in one of the front side grooves and the rear side grooves, and it is a matter of course that this structure also brings about the effect of promoting the diffluence of the heat exchange medium.

It is also possible to use the inner fin with cutout windows of the present invention as an oil cooler or the like in such a manner that the heat exchange medium is made to flow in a direction perpendicular to the protruding ridges. In this case, the effect of stirring by the weir portions is enhanced.

Further, the step of forming the cutout windows may come after the cutting step of cutting the plate to a predetermined length.

INDUSTRIAL APPLICABILITY

The inner fin with cutout window for heat exchange according to the present invention is most suitably utilized as an inner fin used for a heat exchanger such as a condenser of a motor vehicle or the like and loaded in a tube constituting a passage of a heat exchange medium of the heat exchanger.

The invention claimed is:

1. An inner fin with cutout window for heat exchanger comprising:

a plurality of protruding ridges each formed by a wall portion having sidewalls formed with a cutout window, on front and rear sides of a plate respectively, and extending along a longitudinal direction of the plate with a predetermined width, said front side adjacent protruding ridges sandwiching a front side groove and said rear side adjacent protruding ridges sandwiching a rear side groove to serve as passages of a heat exchange medium that are separated from each other by the wall portion; and a weir portion provided at a bottom of an entrance for the heat exchange medium in the cutout window so as to allow said grooves adjacent to each other to communicate with each other, wherein the weir portion is formed by moving material of a portion of at least one of the sidewalls toward the bottom to accumulate on the bottom and form the weir portion protruding from the bottom in a width direction of the plate so that said weir portion can promote diffluence and stirring of the heat exchange medium.

2. The inner fin with cutout window for heat exchanger according to claim 1, wherein said weir portion is formed on each of the bottoms of said grooves both on the front side face and on the rear side face of the plate.

3. A process for manufacturing a cutout window in an inner fin of a heat exchanger, said inner fin being provided with a plurality of protruding ridges each formed by a wall portion having sidewalls formed with a cutout window, on front and rear sides of a plate respectively, and extending along a longitudinal direction of the plate with a predetermined width, said front side adjacent protruding ridges sandwiching a front side groove and said rear side adjacent protruding ridges sandwiching a rear side groove to serve as passages of a heat exchange medium that is separated from each other by the wall portion, the process comprising:

cutting out the sidewalls to form the cutout window, and moving material of a portion of at least one of the sidewalls toward a bottom to accumulate on the bottom and form a weir portion provided at a bottom of an entrance for the heat exchange medium in the cutout window so as to allow said grooves adjacent to each other to communicate with each other, the weir protruding from the bottom in a width direction of the plate so that said weir portion can promote diffluence and stirring of the heat exchange medium.

4. The process according to claim 3, wherein said weir portion is formed on each of the bottoms of said grooves both on the front side face and on the rear side face of the plate.

* * * * *